US007641157B2

(12) United States Patent
Kirkendall

(10) Patent No.: US 7,641,157 B2
(45) Date of Patent: Jan. 5, 2010

(54) GROUND-PENETRATING BEVERAGE HOLDER

(76) Inventor: Allan R. Kirkendall, 688 Evelyn St., Roseburg, OR (US) 97470

( * ) Notice: Subject to any disclaimer, the term of this patent is extended or adjusted under 35 U.S.C. 154(b) by 204 days.

(21) Appl. No.: 11/459,608

(22) Filed: Jul. 24, 2006

(65) Prior Publication Data

US 2008/0017765 A1 Jan. 24, 2008

(51) Int. Cl.
*A45F 3/44* (2006.01)

(52) U.S. Cl. ..... 248/156; 248/153

(58) Field of Classification Search ..... 248/156, 248/153, 530, 311.2, 315; 43/21.2; 47/39, 47/41.14, 47
See application file for complete search history.

(56) References Cited

U.S. PATENT DOCUMENTS

| | | | | | |
|---|---|---|---|---|---|
| 854,178 | A | * | 5/1907 | Ruff | 248/87 |
| 1,178,558 | A | | 4/1916 | Turner | |
| 1,448,808 | A | | 3/1923 | McGowan | |
| 2,021,303 | A | * | 11/1935 | Grennan | 47/47 |
| D130,495 | S | * | 11/1941 | Stewart | D8/356 |
| 2,487,094 | A | * | 11/1949 | Brown | 248/518 |
| 2,506,321 | A | * | 5/1950 | Vosburgh | 248/153 |
| 2,520,818 | A | | 8/1950 | Terry | |
| 2,536,341 | A | * | 1/1951 | Asher | 248/87 |
| 3,523,666 | A | * | 8/1970 | Bloodsworth | 248/514 |
| 3,956,846 | A | * | 5/1976 | Kent | 43/21.2 |
| 4,261,128 | A | * | 4/1981 | Dobbins | 43/21.2 |
| 4,334,661 | A | | 6/1982 | Pitt | |
| D286,591 | S | * | 11/1986 | Russell | D6/417 |
| D308,802 | S | | 6/1990 | Ward | |
| 5,294,083 | A | | 3/1994 | Roth | |
| 5,474,273 | A | | 12/1995 | Vinal | |
| 5,570,863 | A | | 11/1996 | Cooper | |
| 5,823,496 | A | | 10/1998 | Foley et al. | |
| 6,575,417 | B1 | | 6/2003 | Krommenakker | |
| 6,691,973 | B1 | * | 2/2004 | Barfield | 248/530 |
| D490,659 | S | | 6/2004 | Gies | |
| 6,810,630 | B2 | | 11/2004 | Chizmas | |
| 2002/0130236 | A1 | * | 9/2002 | Swensen | 248/315 |

* cited by examiner

*Primary Examiner*—Korie Chan
(74) *Attorney, Agent, or Firm*—Marger Johnson & McCollom, P.C.

(57) ABSTRACT

A beverage support apparatus has first elongate body having a first penetrator at a lower end capable of piercing the ground in a generally vertical manner. A first beverage support is provided on a raised end of the first elongate body. A handle may be disposed on the elongate body and/or be a single beverage support structure. A second elongate body may be spaced from, and arranged in parallel to, said first elongate body and may be structured similar to the first elongate body. A high-volume beverage container retaining member is slidably coupled between the first elongate body and second elongate body for vertical movement therealong, said beverage container retaining member having a retaining portion adapted to fit over a top of a beverage container and rest against an outer surface of the beverage container. The first or second elongate bodies may independently act as beverage holders.

4 Claims, 4 Drawing Sheets

GROUND-PENETRATING BEVERAGE HOLDER

BACKGROUND

This invention relates generally to beverage holders, and more particularly to such holders that are adapted to penetrate the ground and hold beverage containers above the ground.

The growing popularity of outdoor concerts has brought to light several problems for picnickers. First, because the ground typically slopes downward toward the stage, bottles, cans and glasses are prone to fall over on the uneven ground thus increasing the chance of beverages being spilled. This is particularly a problem for stemmed glasses, which include a high center of gravity and are thus even more prone to tipping over on sloped surfaces.

A second issue is the presentation of such beverages at levels that are comfortable to reach for. Concertgoers, especially those attending concerts at wineries, bring lawn chairs to the events and would often need to grope blindly downward to reach a glass, can, or bottle resting on the ground below.

Finally, prior art systems have been known to be difficult to install and/or flimsy at best.

Accordingly, the need remains for a beverage holder that retains beverages level even on uneven ground, at a desired height, and that can be easily installed for use.

SUMMARY OF THE PRESENT DISCLOSURE

The present disclosure provides for a beverage support apparatus. The apparatus includes a first elongate body having a first penetrator at a lower end that is capable of piercing the ground in a generally vertical manner. The first elongate body also has a first beverage support provided on its raised end. Further, the apparatus may include a second elongate body, spaced from and arranged in parallel to said first elongate body, which also has penetrator at a lower end capable of piercing the ground in a generally vertical manner and a beverage support provided on its raised end. A high-volume beverage container retaining member is slidably coupled between the first elongate body and second elongate body for vertical movement therealong. The beverage container retaining member has a retaining portion adapted to fit over a top of a beverage container and rest against an outer surface of the beverage container.

The present disclosure further provides for an alternative beverage support apparatus. This apparatus includes an elongate body having a penetrator at a lower end capable of piercing the ground in a generally vertical manner, a beverage support provided on a raised end of the elongate body, and a handle positioned on the elongate body between the penetrator and the beverage support.

The present disclosure further provides for a method for implementing a beverage holder comprising the steps of: providing a beverage holder having a penetrator, a handle, and a beverage support surface; using the handle, inserting the penetrator into the ground in a generally vertical direction so that the beverage support is elevated above the surface of the ground; and resting a beverage container on the beverage support surface.

The foregoing and other objects, features and advantages of the invention will become more readily apparent from the following detailed description of a preferred embodiment of the invention that proceeds with reference to the accompanying drawings.

BRIEF DESCRIPTION OF THE DRAWINGS

FIG. 3 is a perspective view of one feature of the beverage holder of FIG. 1 used for retaining bottles of wine and the like.

DETAILED DESCRIPTION

Figure 1:
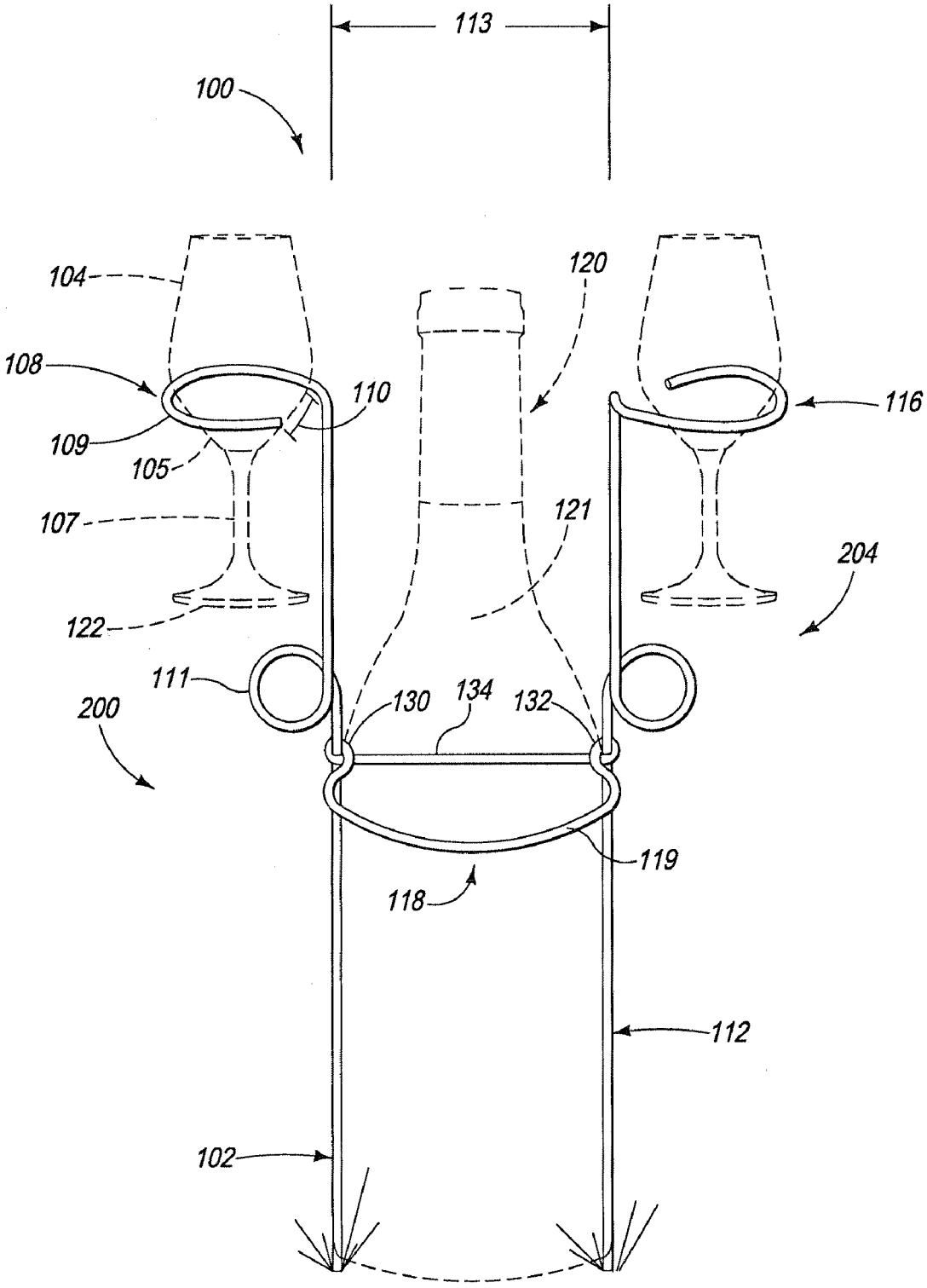
FIG. 1 is a face-on elevation view of a beverage holder constructed according to a preferred embodiment of the invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the disclosure.

Figure 2:
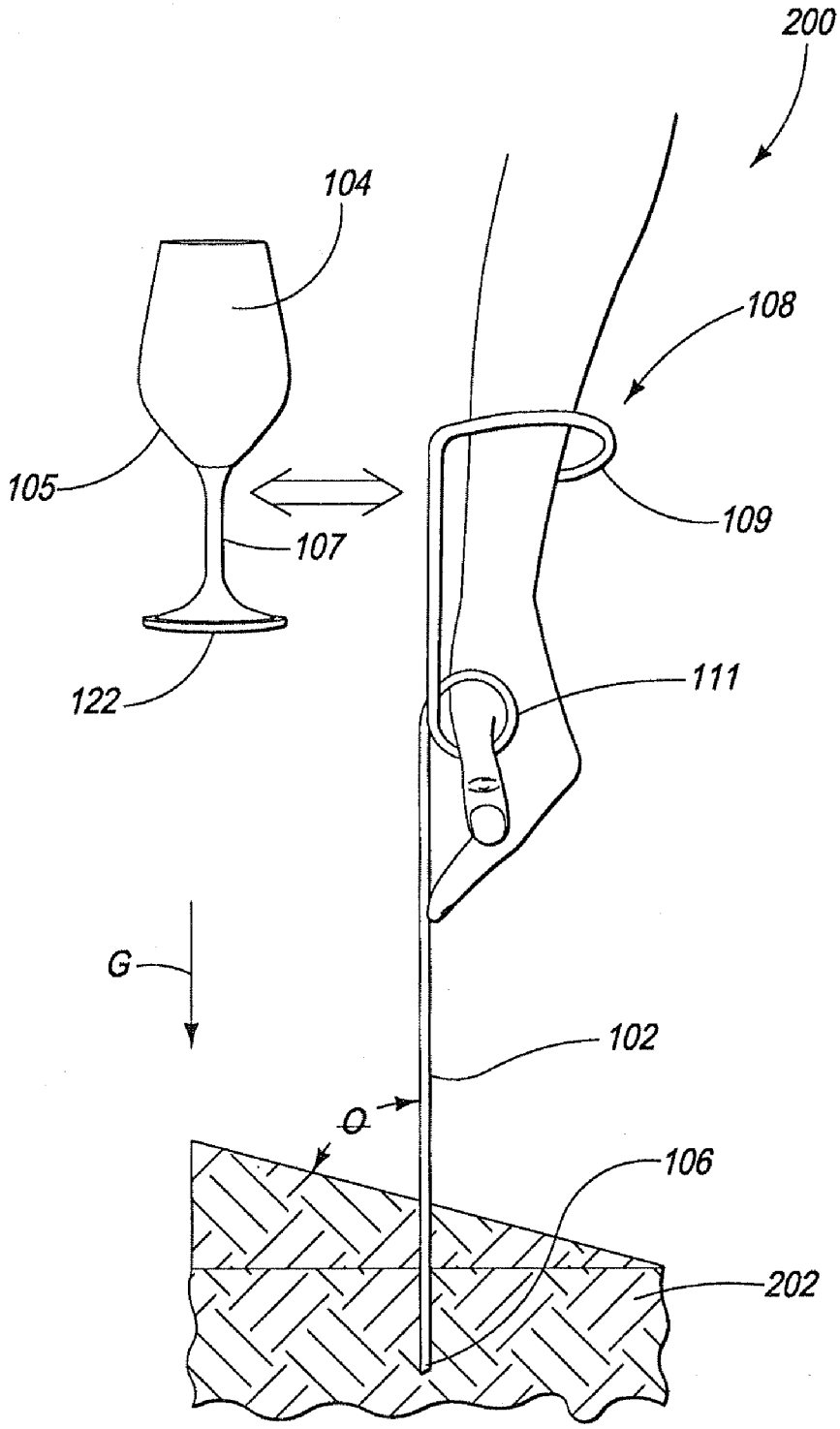
FIG. 2 is an elevation view of an alternate embodiment of the invention adapted specifically for use with stemware.

As illustrated in FIGS. 1 and 2, a beverage support apparatus 100 includes two support elements 200, 204. First support element 200 includes a first elongate body 102. In one preferred embodiment the first elongate body 102 is formed of a wire or metal rod and bent into the shape shown, but body 102 can be made by any means that will fulfill the desired purposes of the apparatus. The first elongate body 102 should be strong enough to support a beverage container, here shown as wine glass 104, without bending or tipping to an extent that the beverage may be spilled.

A first penetrator 106 (FIG. 2) is formed or included at a lower end of the elongate body 102 and is capable of piercing the ground in a generally vertical manner. The first penetrator 106 may just be part of the elongate body 102 in an unaltered form. For example in the wire or steel rod embodiment, the elongate body 102 would have the capability to pierce the ground without special modifications because of the small cross-section of the wire used and stiffness of the material. It may also be desirable to taper or sharpen the first elongate body 102 at the lower end 106 to enable better piercing.

A first beverage support 108 is provided on a raised end of the first elongate body 102. In one embodiment the first beverage support 108 may include an annular support surface 109 with a gap 110 formed therein for use with a container 104. The wine glass 104 shown is of a type that includes a bulb with a sloped undersurface 105 coupled to a stem 107 and thence to a base 122. The annular support surface 109 and gap 110 are structured so that the stem 107 of the glass 104 may be received through the gap 110 and the sloped undersurface 105 of the bulb of the glass 104 lowered until resting against the annular support surface 109 with the base 122 on or suspended above the handle 111.

In one preferred embodiment the beverage support element 200 may include a handle 111 affixed to the elongate body 102. The handle 111 may be a loop formed in the plane of the elongate body 102 whereby a thumb may be received within the loop and used to push the penetrator 106 into the ground (FIG. 2). In this fashion, the hand and forearm of the user may be inserted down through the circular opening formed within the annular support surface 109 and the thumb inserted within the handle 111 so that the webbing of the hand between the thumb and palm pushes down against the lower inside portion of the handle 111. If the hand and arm of the user is too large to fit through the circular opening, the thumb may simply be inserted within the handle loop from the outside. Downward force applied to the apparatus beverage support element 200 in this fashion would then push the elongate body 102 into the ground as shown in FIG. 2 at any angle θ desired, but preferably so that the support element 200 is in a generally vertical manner.

A second support element 204, characterized in a preferred embodiment by a second elongate body 112, may be spaced from and arranged in parallel to said first elongate body 102 by a desired distance 113. The second elongate body 112 may have both a second penetrator at a lower end capable of piercing the ground in a generally vertical manner and second beverage support 116 provided on a raised end of the second elongate body 112. The second elongate body 112 may be implemented in the manner described above for the first elongate body 102 as shown, but is not limited to do so.

Figure 3:
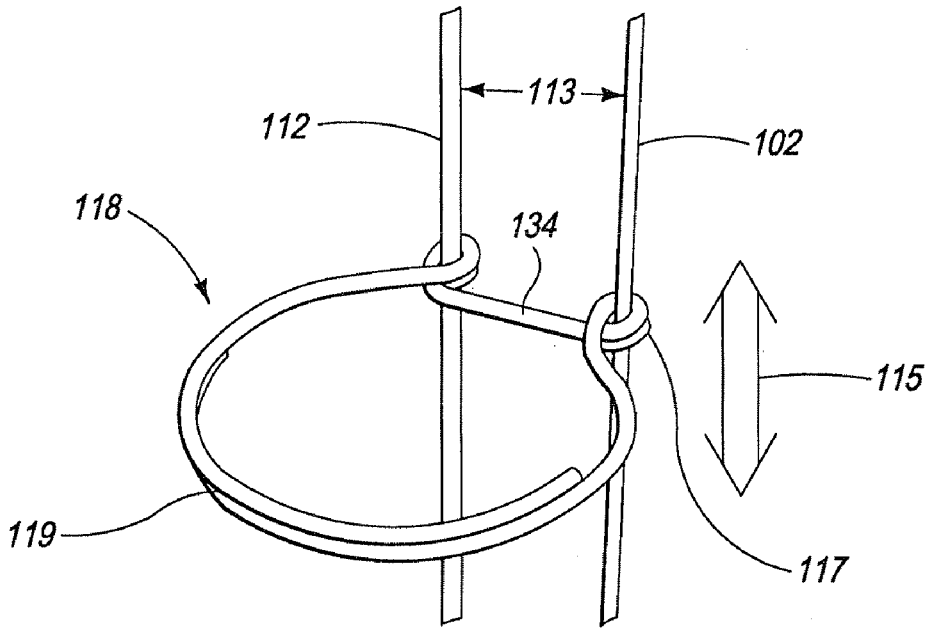
Figure 6:
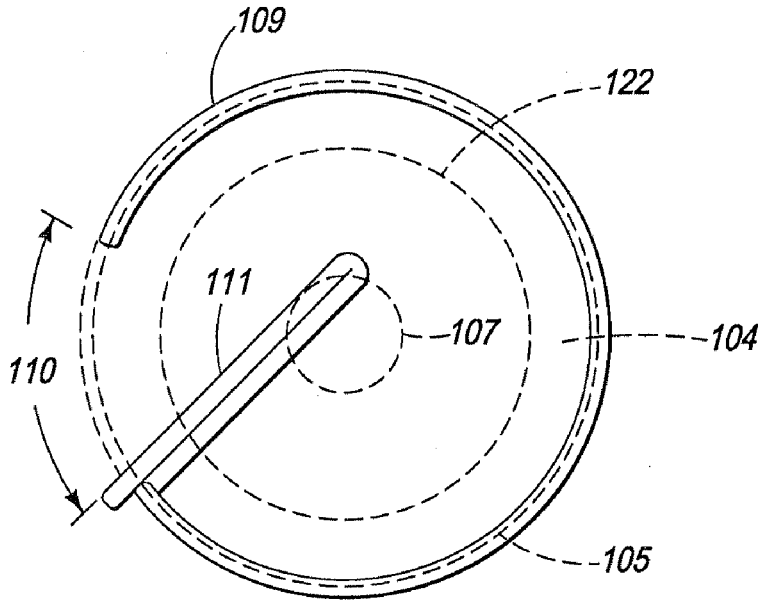
FIG. 6 is a top view of the embodiment of FIG. 2 with a glass shown in dashed outline.

Referring now to FIGS. 1 and 3, a high-volume beverage container retaining member 118 may be slidably coupled between the first elongate body 102 and second elongate body 112 for vertical movement therealong (shown by arrow 115 in FIG. 2). The beverage container retaining member 118 may have a retaining portion 119 adapted to engage the beverage container 120 on an outer surface of the beverage container 120, such as a sloped top surface 121 of wine bottle 120 (shown in dashed outline). The retaining portion 119 of the beverage retaining member 118 may include a substantially circular periphery as shown, and may also include looped portions 130, 132 that wrap around and slidably receive elongate bodies 102, 112, respectively.

The embodiment of retaining member 118 in FIG. 3 is shown with overlapping retaining portions 119. Including the looped portions 130, 132 allows the retaining member 118 to slide vertically 115 along the elongate bodies 102, 112 when the retaining member 118 is aligned perpendicular with respect to the elongate bodies 102, 112 and to be fixed when the retaining member 118 is offset from the perpendicular axis. In that case, it may be preferable to have a double loop 117 (FIG. 3) for better functionality. Double loops 117 have been found to allow greater frictional contact with upright elongate member 102 (and the opposing loops with elongate member 112) so that the retaining member 118 may be manually set at a desired height and then stay at that height when released. The retaining portion 119 may further include a back retaining portion 134 that spans between the loops 130, 132 and elongate bodies 102, 112. The shape and size of the retaining portion 119 may be designed to accommodate any number of beverage container shapes and sizes.

The high volume beverage container 120 (e.g. a wine bottle, 2-liter bottle, etc.) can be inserted through the top of the retaining member 118 until the bottom of the container rests on the ground. Alternately, the retaining member 118 can be slid upward and the container 120 slid underneath and inserted upward through the retaining member opening.

Again referring to FIGS. 1 and 2, an embodiment of the present invention may also be described as a beverage support apparatus 100 comprising an elongate body 102 having a penetrator 106 at a lower end capable of piercing the ground 202 in a generally vertical manner. The apparatus 100 also has a beverage support 108 on a raised end of the elongate body 102, and a handle 111 positioned on the elongate body 102 between the penetrator 106 and the beverage support 108. This embodiment may also be formed continuously from a single wire or metal rod. Ground 202 in FIG. 2 is shown sloped to represent the typical topography of an amphitheater where embodiments of the present invention are likely to be used. Penetrator 106 inserts at an oblique angle θ relative to the sloped ground so that the beverage support 108 defines a plane that is perpendicular to the direction of gravity G.

Figure 4:
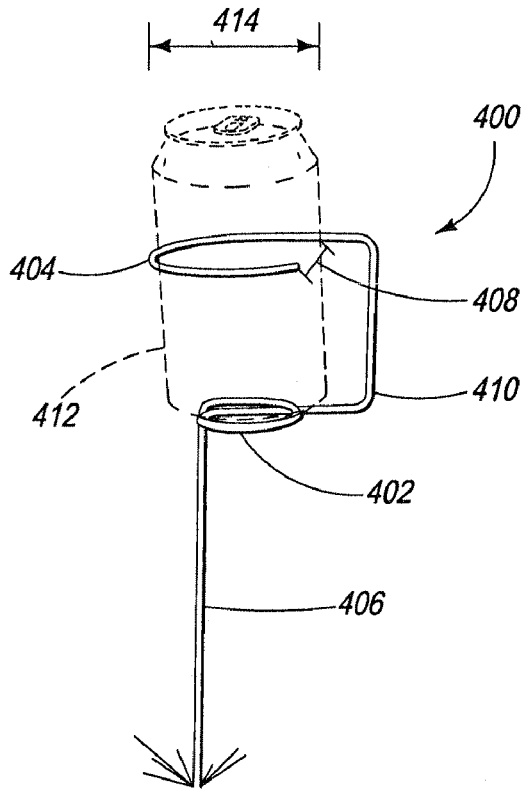
FIG. 4 is an elevation view of a second alternate embodiment of the invention adapted specifically for use with aluminum cans.
Figure 5:
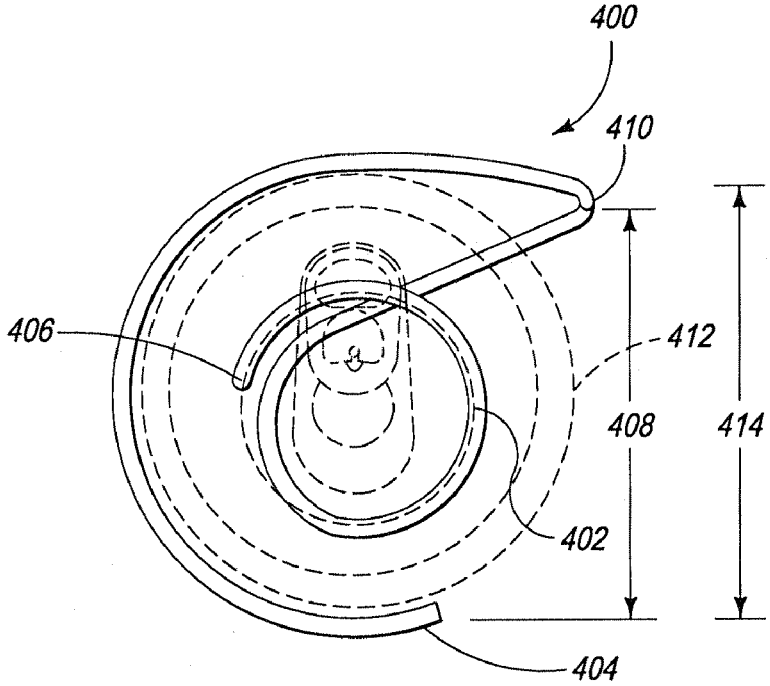
FIG. 5 is a top view of the embodiment of FIG. 4 with a can shown in dashed outline.

FIGS. 4 and 5 illustrate an alternative embodiment for implementing a beverage support 400. The support 400 includes a lower resting portion 402 and an upper retaining portion 404. The upper retaining portion 404 may be formed with a loop in a plane perpendicular to the elongate body 406. The loop on the upper retaining portion 402 may also include a gap 408 for receiving a cylindrical beverage container 412 therethrough where an axis of the elongate body 406 passes up through the interior of the loop. Gap 408 preferably has a dimension approximately equal to a width 414 of container 412 so that the container can be placed within the device 400 via the top or, alternately, from the side through gap 408. If gap 408 is sized to be slightly smaller than a diameter than the can 412, the resilient opposing ends of the upper retaining portion 404 spanning the gap 408 temporarily expand to admit the can, and then snap back to its original dimension so that the can is retained within the device and does not easily slide out.

The upper retaining portion 404 and the lower resting portion 402 may be coupled together via a connection member 410 formed off axis relative to the elongate portion 406. This embodiment for a beverage support 400 may also be included in the continuously formed wire or metal rod embodiment for the elongate body discussed above.

An embodiment of the present invention may also be described as a method for implementing a beverage holder 100 comprising the steps of providing a beverage holder 200 having a penetrator 106, a handle 111, and a beverage support surface 108; using the handle 111, inserting the penetrator 106 into the ground in a generally vertical direction so that the beverage holder 200 is elevated above the surface of the ground 202; and resting a beverage container 104 on the beverage support surface 108.

The beverage support surface in the above method may include an annular surface 109 with a gap 110 formed therein and the beverage container 104 includes a glass having a stem 107 coupled between an underside 105 of the glass and a base 122, the method further comprising inserting the stem 107 of the glass through the gap and resting the underside 105 of the glass on the annular surface 109 so that the base 122 of the glass is suspended above the handle 111.

It is to be understood that the above-referenced arrangements are only illustrative of the application for the principles of the present disclosure. Numerous modifications and alternative arrangements can be devised without departing from the spirit and scope of the present disclosure. While embodiments of the present invention have been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts as set forth herein. I claim all modifications and variation coming within the spirit and scope of the following claims.

What is claimed is:

1. A beverage support apparatus comprising:

a first elongate body having a first penetrator at a lower end capable of piercing the ground in a generally vertical manner;

a first beverage support provided on a raised end of the first elongate body;

a second elongate body spaced from and arranged in parallel to said first elongate body and having a second penetrator at a lower end capable of piercing the ground in a generally vertical manner;

a second beverage support provided on a raised end of the second elongate body, and spaced from said first beverage support to retain a separate beverage, wherein the first and second beverage supports each include a continuous annular support surface subtending an angle greater than 180 degrees with a gap formed therein configured for use with a glass having a bulb with a sloped undersurface coupled to a stem, the annular support surface and said gap being adapted so that the stem of the glass may be received through the gap and the sloped undersurface of the bulb of the glass lowered until resting against the annular support surface;

a high-volume beverage container retaining member slidably coupled between the first elongate body and second elongate body for vertical movement therealong, said beverage container retaining member having a retaining portion adapted to engage a high volume beverage container on an outer surface of the beverage container.

2. The beverage support apparatus of claim 1, further including a handle affixed to each of the first and second elongate bodies.

3. The beverage support apparatus of claim 2, wherein each handle includes a loop formed in the plane of the first and second elongate bodies, respectively, whereby a thumb may be received within the loop and used to push the penetrator into the ground.

4. The beverage support apparatus of claim 1, wherein the annular support surface of the first and second beverage supports is formed of a loop formed in a plane perpendicular to the elongate body.

* * * * *